US006681202B1

(12) United States Patent
Miet et al.

(10) Patent No.: US 6,681,202 B1
(45) Date of Patent: Jan. 20, 2004

(54) WIDE BAND SYNTHESIS THROUGH EXTENSION MATRIX

(75) Inventors: Giles Miet, Le Mans (FR); Andy Gerrits, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 439 days.

(21) Appl. No.: 09/710,822

(22) Filed: Nov. 13, 2000

(30) Foreign Application Priority Data

Nov. 10, 1999 (EP) ..... 99402808

(51) Int. Cl.[7] ..... G10L 11/06

(52) U.S. Cl. ..... 704/214; 704/220; 704/263; 704/228

(58) Field of Search ..... 704/200, 200.1, 704/205–228, 261–269

(56) References Cited

U.S. PATENT DOCUMENTS

| | | | | |
|---|---|---|---|---|
| 4,360,708 A | * | 11/1982 | Taguchi et al. | 704/229 |
| 5,455,888 A | * | 10/1995 | Iyengar et al. | 704/203 |
| 5,581,652 A | | 12/1996 | Abe et al. | 395/231 |
| 5,848,387 A | * | 12/1998 | Nishiguchi et al. | 704/214 |
| 6,233,550 B1 | * | 5/2001 | Gersho et al. | 704/208 |
| 6,415,252 B1 | * | 7/2002 | Peng et al. | 704/208 |

OTHER PUBLICATIONS

Simon Haykin, "Adaptide Filter Theory", Prentice Hall, College Div., 4$^{th}$ Ed. Sep. 14, 2001.

W.B. Kleijn et al., "Speech Coding and Synthesis", Elsevier Health Sciences Nov. 1, 1995.

C.L. Lawson et al., "Solving Least Squares Problems", Prentice Hall Jun. 1974.

P.E. Gill et al., "Practical Optimization", Academic Press, 1981.

Epps J, et al. : Entitled: "A New Technique for Wideband Enhancement of Coded Narrowband Speech" IEE Workshop on Speech Coding. Model, Coders, and Error Criteria, Porvoo, Finland, Jun. 20–23, 1999, pp. 174–176.

By Miet G, et al.: Entitled: "Low–Band Extension of Telephone–Band Speech", IEEE International Conference on Acoustics, Speech, and Signal Processing, Istanbul, Turkey, Jun. 5–9, 2000, pp. 1851–1854 vol. 3.

By Y. Linde, A. Buzo, R.M. Gray: "An Algorithm for Vector Quantizer Design" IEEE Transactions on Communications, vol. COM–28, No 1, Jan. 1980. pp. 84–95.

* cited by examiner

*Primary Examiner*—Richemond Dorvil
*Assistant Examiner*—Abul K. Azad
(74) *Attorney, Agent, or Firm*—Jack D. Slobod

(57) ABSTRACT

The invention describes a system that generates a wide band signal (100–7000 Hz) from a telephony band (or narrow band: 300–3400 Hz) speech signal to obtain an extended band speech signal (100–3400 Hz). This technique is particularly advantageous since it increases signal naturalness and listening comfort with keeping compatibility with all current telephony systems. The described technique is inspired on Linear Predictive speech coders. The speech signal is thus split into a spectral envelope and a short-term residual signal. Both signals are extended separately and recombined to create an extended band signal.

16 Claims, 4 Drawing Sheets

WIDE BAND SYNTHESIS THROUGH EXTENSION MATRIX

FIELD OF THE INVENTION

The invention relates to digital transmission systems and more particularly to a system for enabling at the receiving end to extend a speech signal received in a narrow band, for example the telephony band (300–3400 Hz) into an extended speech signal in a wider band (for example 100–7000 Hz).

BACKGROUND ART

Most current telecommunication systems transmit a speech bandwidth limited to 300–3400 Hz (narrow band speech). This is sufficient for a telephone conversation but natural speech bandwidth is much wider (100–7000 Hz). Actually, the low band (100–300 Hz) and the high band (3400–7000 Hz) are important for listening comfort, speech naturalness and for better recognizing the speaker voice. The regeneration of these frequency bands at a phone receiver would thus enable to strongly improve speech quality in telecommunication systems. Moreover, during a phone conversation, speech is often corrupted by background noise especially when mobile phones are used. Also, the telephone network may transmit music played by switchboards. Therefore, the system that generates the low band and high band should both fit as much as possible to speech and should allow to reduce noise and improve music subjective quality.

The U.S. Pat. No. 5,581,652 describes a Code book Mapping method for extending the spectral envelope of a speech signal towards low frequencies. According to this method, low band synthesis filter coefficients are generated from narrow band analysis filter coefficients thanks to a training procedure using vector quantization as described in the article by Y. Linde, A. Buzo, R. M. Gray: "An algorithm for Vector Quantizer Design", IEEE Transactions on Communications, Vol. COM-28, No 1, January 1980. The training procedure allows to compute two different code books: an extended one for the extended frequency band and a narrow one for the narrow band. Said narrow code book is computed from the extended code book using vector quantization so that each vector of the extended code book is linked with a vector of the narrow band code book. Then the coefficients of the low band synthesis filter are computed from these code books.

However, this method presents some drawbacks, which are responsible for the production of a rattling background sound. First the number of synthesis filter shapes is limited to the size of the code books. Second the extracted vectors in the extended band are not very correlated with the vectors obtained from the linear prediction of the narrow band speech signal. Another method called extension matrix was thus developed in order to improve signal quality at the receiving end.

SUMMARY OF THE INVENTION

It is an object of the invention to provide a method for extending at the receiving end a narrow band speech signal into a wider band speech signal in order to increase signal naturalness and listening comfort which yields to a better signal quality. The invention is particularly advantageous in telephony systems.

In accordance with the invention, the received speech signal is detected with respect to a specific speech characteristic before an extension matrix is applied to the signal, said extension matrix having coefficients depending on said detected characteristic.

In a preferred embodiment of the invention, said specific characteristic called voicing relates to the detected presence of voiced/unvoiced sounds in the received speech signal which can be detected by known methods such as the one described in the manual "Speech Coding and Synthesis", by W. B. Kleijn and K. K. Paliwal, published by Elsevier in 1995. Then the matrixes are computed from a data base, said data base being split with respect to the detected voicing, by applying an algorithm based on Least Squared Error criterion on Linear Prediction Coding (LPC) parameters as described by C. L. Lawson and R. J. Hanson, in "Solving Least Squares Problems", Prentice-Hall, 1974, or based on the Constrained Least Square method described in "Practical Optimization" by P. E. Gill, W. Murray and M. H. Wright published by Academic Press, London 1981.

BRIEF DESCRIPTION OF THE DRAWINGS

The invention and additional features, which may be optionally used to implement the invention, are apparent from and will be elucidated with reference to the drawings described hereinafter.

DETAILED DESCRIPTION OF THE DRAWINGS

Figure 1:
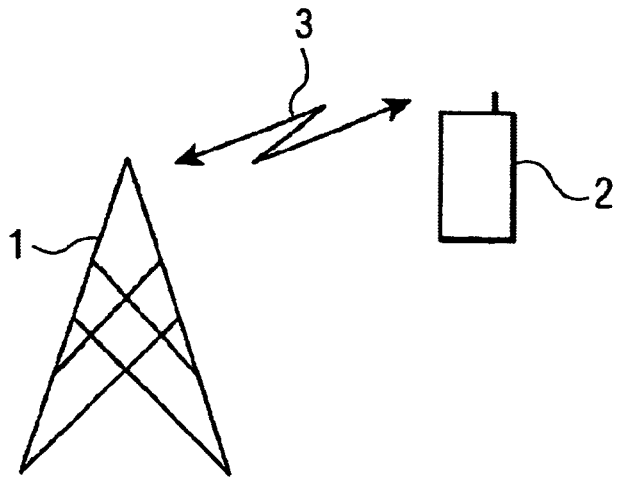
FIG. 1 is a general schematic showing a system according to the invention.

An example of a system according to the invention is shown in FIG. 1. The system is a mobile telephony system and comprises at least a transmission part 1 (e.g. a base station) and at least a receiving part 2 (e.g. a mobile phone) which can communicate speech signals through a transmission medium 3.

The invention also concerns a receiver (FIGS. 2 and 3) and a method (FIG. 4) for improving the audio quality of transmitted speech signals at the receiving part 2.

Speech production is often modeled by a source-filter model as follows. The filter represents the short-term spectral envelope of the speech signal. This synthesis filter is an "all pole" filter of order P that represents the short-term correlation between the speech samples. In general, P equals 10 for narrow band speech and 20 for wide band speech (100–7000 Hz). The filter coefficients may be obtained by linear prediction (LP) as described in the cited manual "Speech Coding and Synthesis", by W. B. Kleijn and K. K. Paliwal. Therefore, the synthesis filter is referred to as <<LP synthesis filter>>.

The source signal feeds this filter, so it is also called the excitation signal. In speech analysis, it corresponds to the difference between the speech signal and its short-term prediction. In this case, this signal called the residual signal is obtained by filtering speech with the <<LP inverse filter>> which is the inverse of the synthesis filter. The source signal is often approximated by pulses at the pitch frequency for voiced speech, and by a white noise for unvoiced speech.

Figure 2:
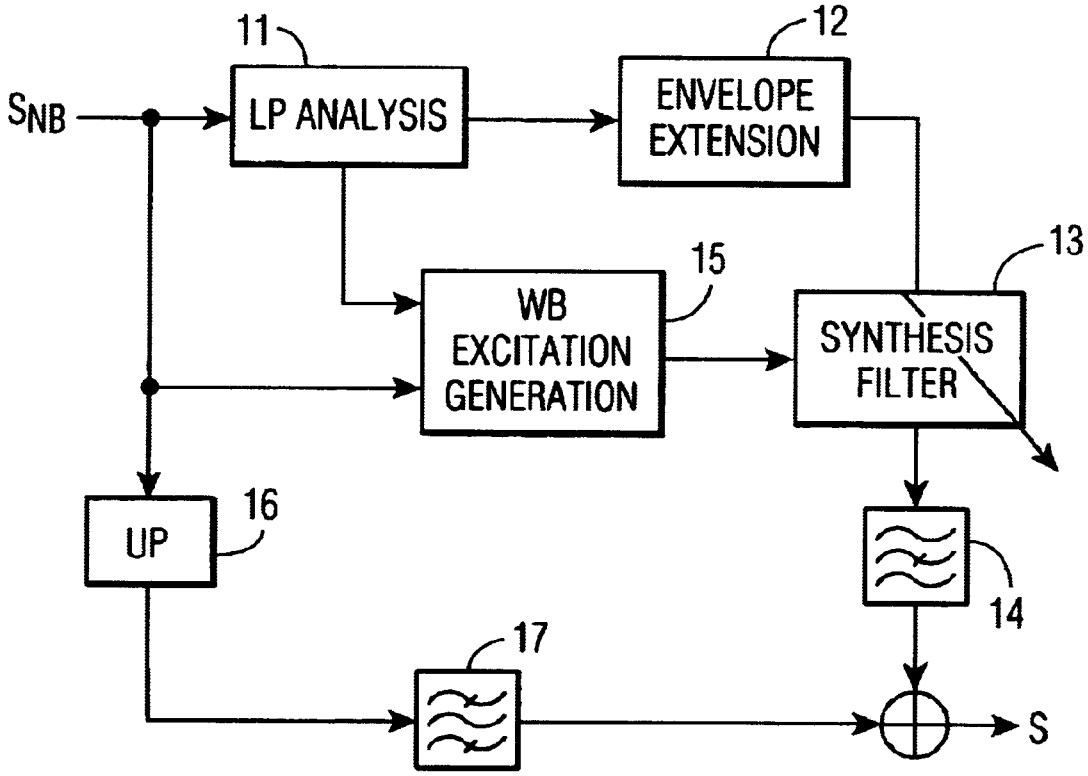
FIG. 2 is a general bloc diagram of a receiver illustrating wide band synthesis according to the invention.

This model enables to simplify the wide band synthesis by splitting this issue into two complementary parts before adding the resulting signals together as shown in FIG. 2 which applies to the low band signal generation (100–300 Hz) as well as the high band generation (3400–7000 Hz).

During the generation of the wide band spectral envelope from the narrow band speech spectral envelope, the problem is to obtain the synthesis filter coefficients. This is made by Linear Prediction analysis 11 of the narrow band speech signal SNB, then envelope extension 12 for controlling a synthesis filter 13 and a rejection filtering 14 for rejecting the narrow band signal which will be better extracted from the original narrow band speech signal. From the original narrow band speech signal SNB and the LP analysis bloc 11, the wide band excitation signal is generated for exciting the synthesis filter 13.

The creation of the wide band excitation signal from the narrow band residual (or a derivative of it) is made by up-sampling 16 the received signal SNB and band-pass filtering 17 for obtaining the narrow band from the original signal.

Most of the source-filter methods use the same principle to determine the low band synthesis filter. In a first step, the speech signal envelope spectrum parameters are extracted by LP analysis 11. These parameters are converted into an appropriate representation domain. Then, a function is applied on these parameters to obtain the Low band synthesis filter parameters 13. The particularity of each method resides principally in the choice of the function that is employed to create the low band LP synthesis filter.

The determination of the excitation signal is also important as the maximum rejection level of the low band is not specified by telecommunication standard. In this case, methods that try to recover the low band residual of the speech signal before transmission from the received low band residual are quite risky because the signal to quantization noise ratio is unknown in this frequency band.

The gist of the invention is to create a linear function to derive the extended band spectral envelope from the narrow band spectral envelope. A method according to the invention for creating this function will be described hereafter in relation to FIG. 4.

Figure 3:
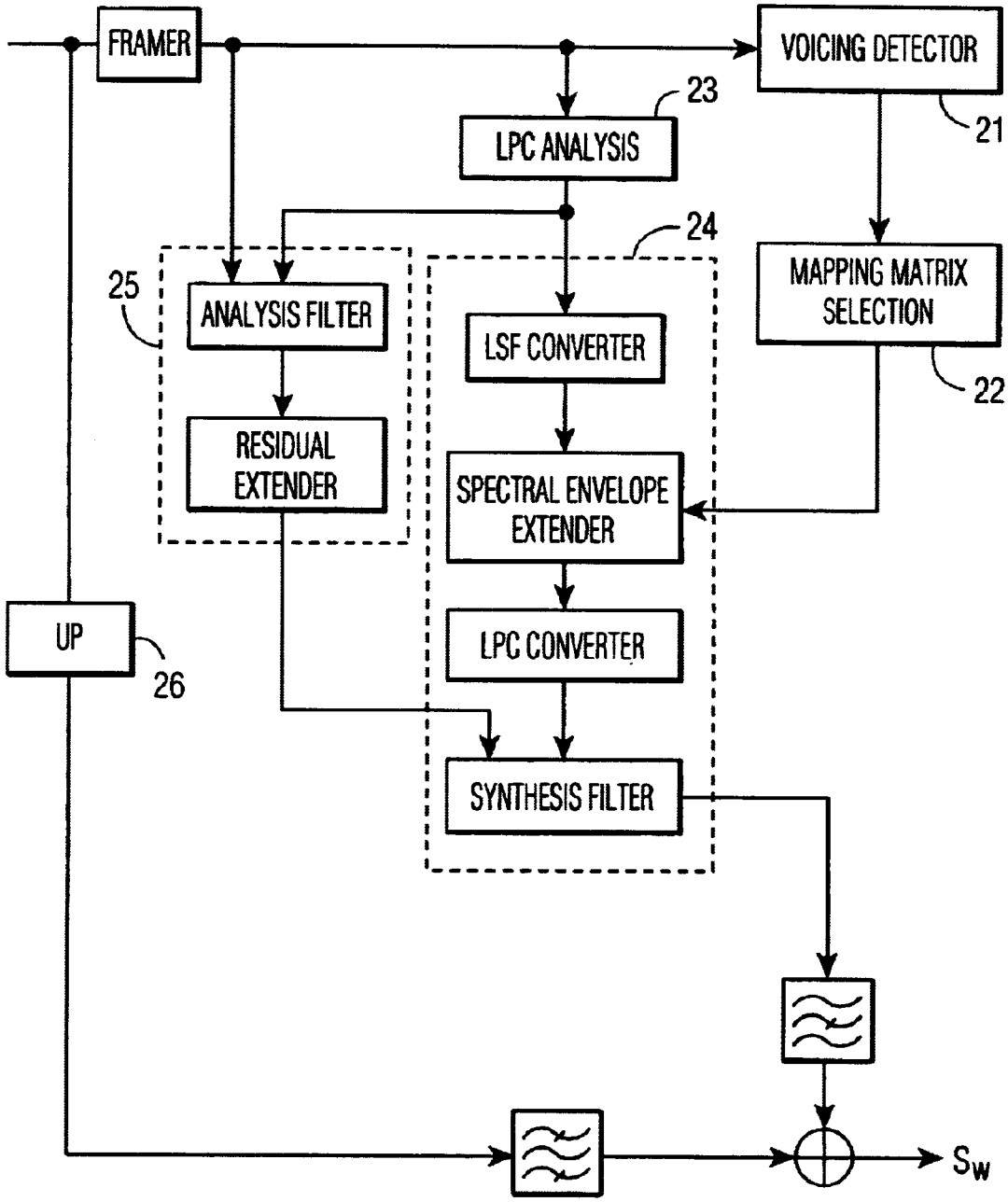
FIG. 3 is a general bloc diagram of a receiver according to a preferred embodiment of the invention.

A preferred embodiment of the invention is shown in FIG. 3 introducing a voicing detection in order to apply a different linear function with respect to the content of the received signal. An overview of the low band extension scheme is given. The same applies to the high band extension. In this embodiment, $S_N$ denotes the narrow band speech, which is, for example, a signal between 0 and 4 kHz. The synthesized wide band speech is, for example, between 0 and 8 kHz and is denoted $S_W$. The narrow band speech is segmented into segments of 20 ms, referred to as a speech frame.

A voicing detector 21 uses the narrow-band speech segment to classify the frame. The frame is either voiced, unvoiced, transition or silence. The classification is called the voicing decision and is indicated as voicing in FIG. 3. The voicing detection will be described afterwards. The voicing decision is used for selecting the mapping matrix 22. The order of the LPC analysis filter 23 may be 40 to have a high order estimate of the envelope. Using the current speech frame and the calculated LPC parameters, the narrow-band residual signal is created.

The envelope and the residual are extended in parallel. To extend the envelope, the LPC parameters are first converted in LSF parameters. Using the voicing decision a mapping matrix 22 is selected. There are 4 different mapping matrices dependent on the voicing decision: voiced, unvoiced, transition and silence. The mapping matrices are created during an off-line training as described in relation to the FIG. 4. Using the narrow-band LSF vector and the appropriate mapping matrix, the extended wide-band LSF vector is calculated. This LSF vector is then converted to direct form LPC parameters which are used in the synthesis filter 24.

A wide band excitation generation bloc 25 using LPC analysis results is used to excite the synthesis filter 24. The narrow band signal $S_N$ is up-sampled 26 by zero padding before band-pass filtering 27 to complete the wide band signal $S_W$.

The residual extension performs better if a high order LPC analysis is used. For this reason the system uses a 40th order LPC analysis. The order of both narrow-band and wide-band LPC vectors is 40. Although the performance of the envelope extension decreases slightly, the overall quality of the above system increases by the high order LPC vectors.

For the voicing detection the algorithm is used as described in (TN harmony). This algorithm classifies a 10 ms segment into either voiced or unvoiced. An energy threshold is added to indicate silence frames. So, for a 20 ms frame, 2 voicing decision are taken. Based on these two voicing decisions the frame is classified.

In the following table it is shown how the classification in 4 categories is made dependent on the 2 voicing decisions.

TABLE 1

| Voicing decision | | |
|---|---|---|
| Vuv1 | Vuv2 | Voicing decision frame |
| Voiced | voiced | voiced |
| Voiced | unvoiced | transition |
| Voiced | silence | transition |
| Unvoiced | unvoiced | unvoiced |
| Unvoiced | silence | unvoiced |
| Silence | silence | silence |

The voicing decision of the frame is used to select the mapping matrix and to apply gain scaling in unvoiced cases.

Figure 4:
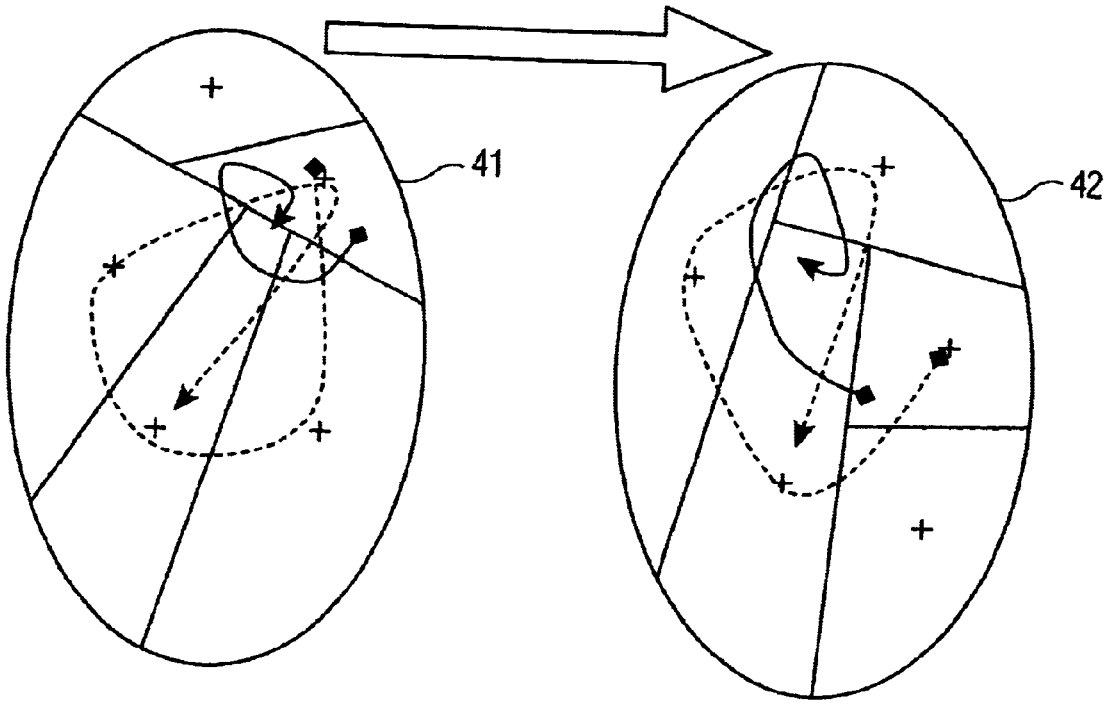
FIG. 4 is a bloc diagram illustrating a method according to the invention.

A method for implementing the preferred embodiment shown in FIG. 3 is described with respect to FIG. 4. The algorithm requires two major stages to run. The first one is a training stage where extension matrixes are computed for extending the bandwidth at the receiving end. The second one is simply for running the bandwidth extension algorithm on the target product for example a mobile telephone handset.

FIG. 4 relates to the training stage. It shows the LSF extension from a narrow-band LSF space 41, to an extended band LSF space 42. In the narrow-band space 41, the original LSF path is represented by a continuous line, while vector quantification LSF jump is represented by a non continuous line. In the extended band space 42, the matrix extended LSF path is represented by a continuous line while the code book mapped LSF centroide jumps is represented by a non continuous line. Only extension matrixes preserve proximity and continuity.

Figure 5:
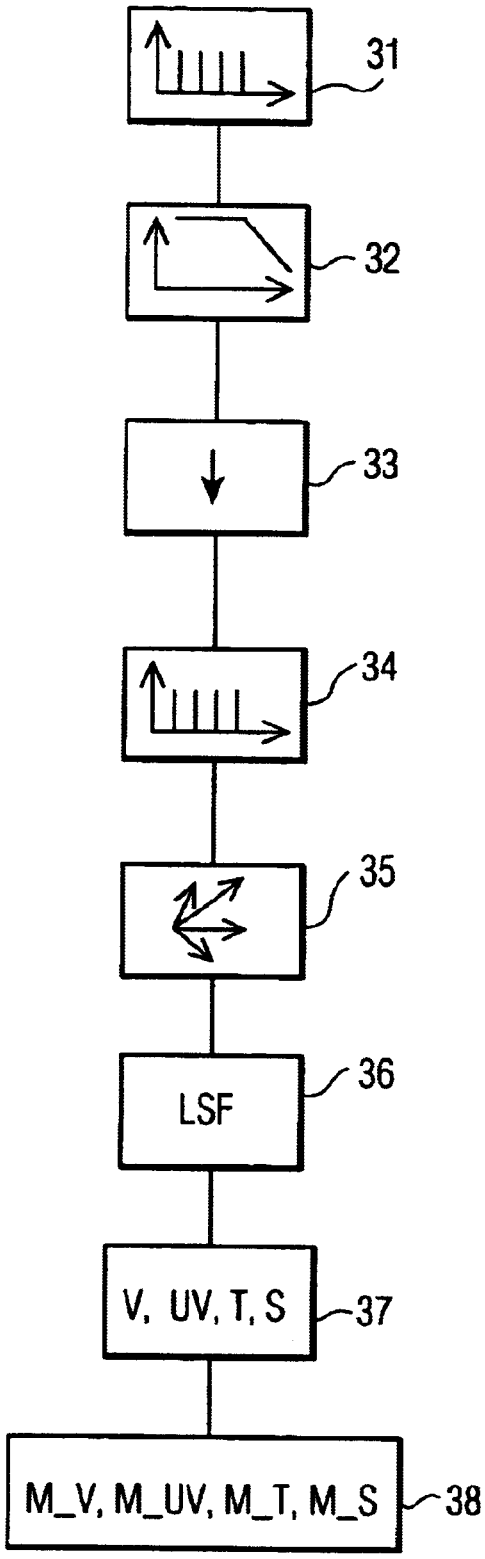
FIG. 5 is a schematic showing the path of consecutive LSF in narrow band and extended band spaces.

The extension matrixes are generated as illustrated in FIG. 5, for example from 16 kHz phonetically balanced speech samples. The steps are illustrated with the boxes 31 to 38:

Step 31: the speech samples are split into, for example, 20 ms consecutive windows (320 samples) which will be referred to as the wide band windows.

Step 32: these speech samples are filtered by a low-pass filter (to cut-off frequencies above 4 kHz).

Step 33: the filtered speech samples are then down sampled to 8 kHz.

Step 34: the down sampled speech samples are split into 20 ms consecutive windows (160 samples) which will be referred to as the narrow band windows, in order to have a correspondence between narrow band and wide band windows for a given window index.

Step 35: each narrow or wide band window is classified with respect to a speech criteria such as the presence of sounds which are voiced/unvoiced/transition/silence, etc.

Step 36: for each window, a high order LSF vector is computed, for example 40th order.

Step 37: each narrow band LSF vector and its corresponding wide band LSF vector are put into a cluster among voiced, unvoiced, transition, silence, etc.

Step 38: For each cluster, an extension matrix is computed as described below. These matrixes denoted M_V; M_UV; M_T; M_S respectively for voiced; unvoiced; transition and silence LSF determine a wide band LSF vector from a narrow band LSF vector with respect to its class. For example, for a narrow band voiced LSF vector denoted LSF_WB, the wide band LSF vector denoted LSF_NB is computed as follows:

$$LSF_WB=M_V\times LSF_NB.$$

Instead of a voicing detection, other speech signal characteristics could be detected in order to make different classifications of the received signals such as a recognition based on phoneme models or a vector quantification.

The creation of the extension matrix in step 38 according to the preferred embodiment of the invention is explained hereafter to derive the extended band spectral envelope from the narrow band spectral envelope.

Let denote $W_e=(w_e(1),w_e(2), \ldots ,w_e(P))^t$ the extended band LSF vector and $w_n=(w_n(1),w_n(2), \ldots ,w_n(P))^t$ the narrow band LSF vector, both being of order P, where $w_n(i)$ represents with the narrow band LSF and $w_e(i)$ represents the with extended band LSF.

The extension matrix M is defined as follows by $w_e^t=w_n^t\cdot M$, where M is a P×P matrix whose coefficients are denoted m(k,k), with $1\leqq k\leqq P$:

$$[\,w_e(1)\quad w_e(2)\quad \cdots\quad w_e(P)\,]=[\,w_n(1)\quad w_n(2)\quad \cdots\quad w_n(P)\,]\cdot \begin{bmatrix} m(1,1) & m(1,2) & \cdots & m(1,P) \\ m(2,1) & m(2,2) & \cdots & m(2,P) \\ \vdots & \vdots & \vdots & \vdots \\ m(P,1) & m(P,2) & \cdots & m(P,P) \end{bmatrix} \tag{1}$$

Thus, the spectral envelope extension is computed by multiplying the narrow band LSF vector by the extension matrix giving an extended spectral envelope LSF vector. As depicted in FIG. 5, showing the path of consecutive LSF in narrow band and extended band spaces, the extension matrix enables to provide wide band LSF vectors with the following interesting proprieties:

- wide band LSF vectors are correlated with the narrow band LSF,
- a continuous evolution of narrow band LSF leads to a continuous evolution of extended band LSF,
- the extended band LSF set size is infinite.

These characteristics of the original extended band LSF were not conserved with the code book mapping method. The equation (1) requires a pre-calculation of the matrix M.

According to a first embodiment of the invention, the matrix M is computed using the Least Square (LS) algorithm as described in the manual by S. Haykin, "Adaptive Filter Theory", 3rd edition, Prentice Hall, 1996.

In this case, the equation (1) is first extended to $$W_e=W_n\cdot M \tag{2}$$

where:

$$W_e=\begin{bmatrix} W_{e1}^t \\ \vdots \\ W_{eN}^t \end{bmatrix}$$

and $W_{ek}$ is the $k^{th}$ extended band vector, with k=[1 . . . N]

Thus, each row of $W_n$ and $W_e$ correspond to a narrow band LSF and its corresponding extended band LSF. Then, M is computed by the formula:

$$M=(W_n^tW_n)^{-1}W_n^tW_e. \tag{3}$$

Although the formula (3) will provide the best approximation in the least square sense, this is probably not the best extension matrix to be applied to LSF domain. Indeed, the LSF domain has not a structure of vector space. Therefore, (3) is likely to lead to extended vectors that do not belong to the LSF domain. This was confirmed by simulations where an important number of extended vectors did not fall in the LSF domain. The LSF domain is warranted by the condition:

$$0<w_1<w_2<\ldots<w_P<\pi \tag{4}$$

Consequently, two possibilities arise:

- Changing the spectral envelope representation domain such that it has a structure of vector space (e.g. LAR).
- Applying a constraint that reflects (4) during the computation of the extension matrix. Because LSF is the preferred representation domain for spectral envelope, it has been decided to opt for the second possibility.

According to a second embodiment of the invention, formula (3) is replaced by the following formula (5):

$$M=\arg_N\min\{\mathrm{tr}[(W_e-NW_n)^t(W_e-NW_n)]\},\ \text{with } n(i,j)\geqq 0,\ \forall(i,j)\epsilon[1\ldots P]^2 \tag{5}$$

This constraint makes sure that the LSF coefficients are not negative. The algorithm that was used to solve (5), called the Non Negative Least Squares (NNLS), is described by C. L. Lawson and R. J. Hanson, in the manual "Solving Least Squares Problems", Prentice-Hall, 1974.

However, this algorithm has two drawbacks

- It is quite stringent because all the matrix elements are forced to be positive.
- It does not guarantee the LSF ordering.

Consequently, the matrix is not the optimal one, which limits the performances of the extension process. Besides, there are some situations where the computed $w_e$ do not obey to the constraint of equation (4). This leads to an unstable filter. To avoid it, the extended band LSF vector has to be artificially stabilized.

Although, informal listening tests showed that the NNLS algorithm provided encouraging performances, M has to be determined differently.

According to a preferred embodiment of the invention, the Constrained Least Square (CLS) algorithm is used. Here, the optimization has to be computed on a vector. Thus, it is necessary to concatenate the columns of M.

From (1), it can be derived:

$$w_{ek} = W_n^k \cdot \begin{bmatrix} m_1 \\ \vdots \\ m_P \end{bmatrix}, \text{ with } m_1 = \begin{bmatrix} m(1, i) \\ \vdots \\ m(P, i) \end{bmatrix} \forall\, i \in [1 \cdots P] \text{ and } W_n^k = \begin{bmatrix} w_{nk}^t & 0 & \cdots & 0 \\ 0 & w_{nk}^t & \ddots & \vdots \\ \vdots & \ddots & \ddots & 0 \\ 0 & \cdots & 0 & w_{nk}^t \end{bmatrix} \tag{6}$$

$$\text{and then, } \begin{bmatrix} w_{e1} \\ \vdots \\ w_{eN} \end{bmatrix} = \begin{bmatrix} W_n^1 \\ \vdots \\ W_n^N \end{bmatrix} \cdot \begin{bmatrix} m_1 \\ \vdots \\ m_P \end{bmatrix} \tag{7}$$

Now, the constraint of equation (4) can be translated by $$P \cdot W_{ek} \begin{bmatrix} -w_{ek}(1) \\ w_{ek}(1) - w_{ek}(2) \\ \vdots \\ w_{ek}(P) \end{bmatrix} \le e, \tag{8}$$

$$\text{with } P = \begin{bmatrix} -1 & 0 & \cdots & 0 \\ 1 & \ddots & \ddots & \vdots \\ 0 & \ddots & \ddots & 0 \\ \vdots & \ddots & \ddots & -1 \\ 0 & \cdots & 0 & 1 \end{bmatrix} \text{ and } e = \begin{bmatrix} 0 \\ \vdots \\ 0 \\ \pi \end{bmatrix}$$

$$\text{And then, } P \cdot W_n^k \begin{bmatrix} m_1 \\ \vdots \\ m_P \end{bmatrix} \le e \tag{9}$$

For all the acquisitions, it corresponds to, $$P \cdot \begin{bmatrix} W_n^1 \\ \vdots \\ W_n^N \end{bmatrix} \cdot \begin{bmatrix} m_1 \\ \vdots \\ m_P \end{bmatrix} \le \begin{bmatrix} e \\ \vdots \\ e \end{bmatrix} \tag{10}$$

Thus, the matrix can be computed from the CLS algorithm:

$$y = \underset{x}{arg\min} \|Ax - b\|, \text{ with } Cx \le d, \text{ with } x = \begin{bmatrix} m_1 \\ \vdots \\ m_P \end{bmatrix}, \tag{11}$$

$$A = \begin{bmatrix} W_n^1 \\ \vdots \\ W_n^N \end{bmatrix}, b = \begin{bmatrix} w_{e1} \\ \vdots \\ w_{eN} \end{bmatrix}, C = P \cdot \begin{bmatrix} W_n^1 \\ \vdots \\ W_n^N \end{bmatrix} \text{ and } d = \begin{bmatrix} e \\ \vdots \\ e \end{bmatrix}$$

The wide band excitation generation can be done by using a method such as the one described in the U.S. Pat. No. 5,581,652 cited as prior art.

What is claimed is:

1. Telecommunications system comprising at least a transmitter and a receiver for transmitting a speech signal with a given bandwidth, the receiver comprising means for extending the bandwidth of the received signal, wherein said receiver comprises:

means for receiving a band-limited signal as input;

means for segmenting said band-limited signal into a plurality of speech frames;

a detector for characterizing each speech frame of said band-limited input signal;

means for selecting one of a plurality of mappings in accordance with said characterization;

analysis means for extracting filter coefficients of said band-limited input signal;

means for creating a band-limited residual signal from a current speech frame of said input filter coefficients;

means for extending the bandwidth of said band-limited residual signal;

means for calculating a set of bandwidth-extended filter coefficients using said filter coefficients and said selected mapping; and a synthesis filter for outputting said extended bandwidth signal, said filter including means for filtering said bandwidth extended residual signal with said bandwidth extended filter coefficients.

2. The system of claim 1, wherein said speech characterization is a voicing decision.

3. The system of claim 1, wherein said filter coefficients are linear prediction coefficients (LPCs).

4. The system of claim 1, wherein said filter coefficients are LSF representations of said linear prediction coefficients.

5. The method of claim 1, wherein said mappings are matrices.

6. A receiver for receiving speech signals with bandwidth and comprising means for extending the bandwidth of the received signal, wherein said receiver comprises:

means for receiving a band-limited signal as input;

means for segmenting said band-limited signal into a plurality of speech frames;

a detector for characterizing each speech frame of said band-limited input signal means for selecting one of a plurality of mappings in accordance with said charactization;

analysis means for extracting filter coefficients of said band-limited input signal;

means for creating a band-limited residual signal from a current speech frame of said input signal and said filter coefficients;

means for extending the bandwidth of said band-limited residual signal;

means for calculating a set of bandwidth-extended filter coefficients using said filter coefficients and said selected mapping; and a synthesis filter for outputting said extended bandwidth signal, said filter including means for filtering said bandwidth extended residual signal with said bandwidth extended filter coefficients.

7. A method for extending at the receiving end, the bandwidth of a received signal, the method comprising the steps of:

receiving a band-limited signal as input;

segmenting said band-limited input signal into a plurality of speech frames;

characterizing each speech frame of said band-limited input signal;

selecting one of a plurality of mappings in accordance with said characterization;

extracting filter coefficients of said band-limited input signal;

creating a band-limited residual signal from a current speech frame of said band-limited input signal and said filter coefficients;

extending the bandwidth of said band-limited residual signal;

calculating a set of bandwidth-extended filter coefficients using said filter coefficients and said selected mapping; and filtering said bandwidth extended residual signal with said bandwidth extended filter coefficients to produce a first extended bandwidth signal.

8. The method of claim 7, wherein said step of characterizing each speech frame further comprises making at least one voicing decision on each speech frame.

9. The method of claim 7, further comprising the steps of:

high-pass filtering said first extended bandwidth signal;

up-converting said band-limited input signal;

low-pass filtering said up-converted band-limited input signal;

combining said high-pass filtered extended bandwidth signal with said low-pass filtered up-converted band-limited signal to produce a second extended bandwidth signal.

10. The method of claim 7, wherein said step of characterizing each speech frame further comprises characterizing each speech frame as one of a voiced, unvoiced, transition or silent speech frame.

11. The method of claim 7, wherein said filter coefficients are linear prediction coefficients (LPCs).

12. The method of claim 11, wherein said mapping matrices are created at a configuration stage.

13. The method of claim 7, wherein said filter coefficients are LSF representations of said linear prediction coefficients.

14. The method of claim 7, wherein said mappings are mapping matrices.

15. A computer program product comprising a computer usable medium having computer readable program code embodied in the medium, when said medium is loaded into a receiver, cause the receiver to carry out the method as claimed in claim 7.

16. An article of manufacture comprising a computer usable medium having computer readable program code means embodied therein for causing a computer to effect the method as claimed in claim 7.

* * * * *